United States Patent [19]

Komulainen

[11] 4,128,213

[45] Dec. 5, 1978

[54] METHOD FOR REGULATING A WINDING PROCESS

[75] Inventor: Pekka Komulainen, Kemi, Finland

[73] Assignee: Oy Wartsila AB, Helsinki, Finland

[21] Appl. No.: 862,759

[22] Filed: Dec. 20, 1977

[30] Foreign Application Priority Data

Dec. 28, 1976 [FI] Finland ..... 763709

[51] Int. Cl.[2] ..... B65H 17/08

[52] U.S. Cl. ..... 242/66; 242/67.1 R

[58] Field of Search ..... 242/66, 67.1 R, 67.2, 242/67.3, 67.4, 67.5, 75, 75.2, 55

[56] References Cited

U.S. PATENT DOCUMENTS

| | | | |
|---|---|---|---|
| 1,455,976 | 5/1923 | Stevens | 242/66 |
| 1,803,043 | 4/1931 | Valentine | 242/66 |
| 2,441,439 | 5/1948 | Nelson | 242/66 X |
| 3,064,915 | 11/1962 | Hornstein | 242/66 |

*Primary Examiner*—Edward J. McCarthy

*Attorney, Agent, or Firm*—Haseltine, Lake & Waters

[57] ABSTRACT

A method for regulating the internal tension of a web roll being wound between two underlying support rolls and an upper rider roll. During the whole winding process the distance between the centers of the support rolls is kept smaller than the sum of the distances from the center of the web roll to the centers of the support rolls. At the beginning, the support rolls are continuously moved farther away from each other and at a later phase of the winding process the supporting rolls are moved towards each other. The distance between the support rolls is preferably regulated so that the sum of the nip pressures provided by the support rolls and the rider roll is substantially constant.

9 Claims, 4 Drawing Figures

METHOD FOR REGULATING A WINDING PROCESS

Figure 1:
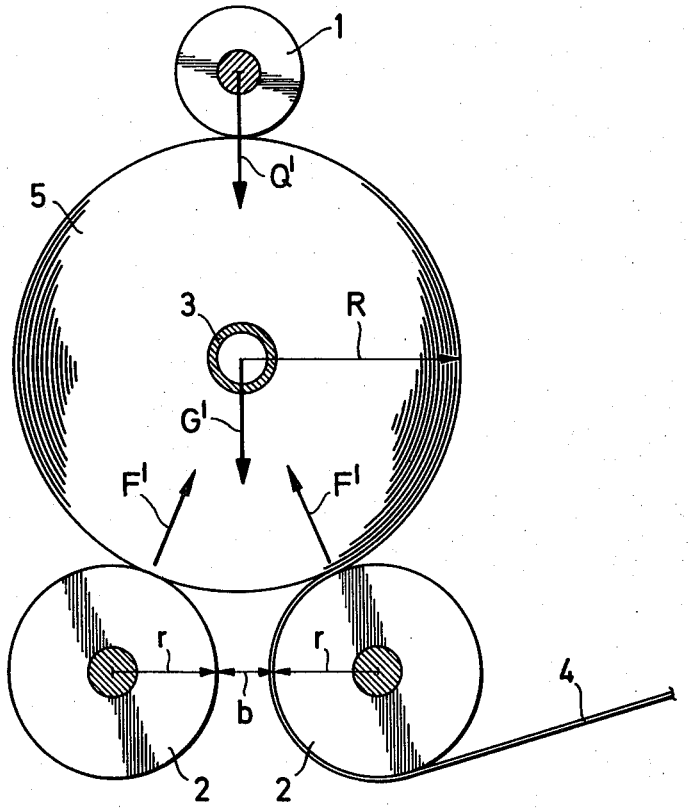

The invention relates to a method for regulating the internal tension of a web roll being wound in a winder including two support rolls and a rider roll surrounding said web roll, the distance between the centers of the support rolls being kept, during the whole winding process, smaller than the sum of the distances from the center of the web roll to the center of said support rolls.

In a winder of the kind referred to, usually called drum winder, the nip pressures applied to the web roll of paper or the like by an upper rider roll and two underlying support rolls should be regulated so as to obtain a good web roll buildup when also other operating parametres, such as the braking tension of the web and the torque difference of the support rolls, are taken into account. The customers ordering paper rolls want to have rolls with a maximum diameter irrespective of the paper density and other qualities. In practice, it has proved to be extremely difficult to wind big rolls of good quality. For example, when winding newsprint paper with a density of 0.7 g/cm$^3$, it is possible to obtain, in a drum winder, a roll diameter of, in the best case, about one meter, if the gravity force of the roll is equalized only by means of a rider roll.

In order to be able to wind web rolls of larger diameter a good program is needed for regulating the nip pressures applied to the web roll. It has not been possible, however, to develop regulation models of sufficient quality, but all the known ways of regulating the winding process in drum winders include drawbacks. To mention some general disadvantages, the nip pressure between the rider roll and the web roll often causes damages in the web rolls and the outer layers of the web rolls usually become too tight.

One object of the invention is to eliminate the drawbacks of the known methods for regulating the roll winding process of a drum winder and to improve the quality of the wound web roll, and/or to make it possible to wind web rolls of larger diameter than before. The invention is characterized in that at the beginning of the winding process the support rolls are continuously moved farther away from each other and that at a later phase of the winding process the supporting rolls are moved towards each other. By this means the most advantageous nip pressure distribution can be applied to the web roll during the whole winding process, whereby web rolls of better quality and/or of larger diameter can be achieved.

By keeping the angle between a line through the centers of the support rolls and a line through the center of a support roll and of the web roll at least substantially constant during the phase of moving the support rolls away from each other, an almost symmetric load is obtained at the beginning of the winding process especially if the nip pressure of the rider roll at the beginning is kept close to a chosen initial value, preferably is allowed to slightly decrease. After the initial phase, the nip pressure of the rider roll is allowed to continuously decrease until it has reached a relatively small final value. Thus, the web roll does not so easily become oval, it will not be subject to vibrations caused thereby, and the drawbacks due to different dimensions of the web roll core can largely be avoided, whereby the core can take up a greater rider roll load.

Especially in the final phase of the winding process, when faults caused by thickness profile variations in the web become more apparent, the equalisation of the gravity force of the web roll should be accomplished without any great rider roll load. In addition it is known, that the tension in a web leaving a roll nip is the sum of the tension in the web before the nip and the tension produced therein in the nip. A drum winding process includes three nips, two support roll nips and a rider roll nip, which each thus provide an increased tension in the web. For this reason, it is of advantage to regulate the distance between the support rolls so that the sum of the nip pressures applied to the web roll by the support rolls and the rider roll is at least substantially constant.

Expressed in a more precise form, the nip pressure provided by the rider roll can, at the beginning of the winding process, be regulated at least substantially in accordance with the following expression:

$$Q = \frac{C \sin(a) - G}{1 + \sin(a)},$$

wherein

Q = the nip pressure between the rider roll and the web roll

C = a constant a = the angle between a line through the centers of the support rolls and a line through the center of a support roll and of the web roll.

G = the total weight of the web roll per axial length unit.

The value of C can be determined by means of the following equations:

$$2F + Q = C$$

$$C = C_1 + \frac{C_2 - C_1}{L_2} L$$

$$C_1 = 2F_1 + Q_1$$

$$C_2 = 2F_2 + Q_2$$

$$F_2 = \frac{m''L_2 g + G_1 + Q_2}{2\sin(a_2)}$$

$$F_1 = \frac{G_1 + Q_1}{2\sin(a_1)}$$

wherein

F = the nip pressure applied to the web roll by a support roll

L = the length of the web in the web roll m'' = the mass of the web per square unit $G_1$ = the gravity force of the web roll core per axial length unit g = the gravity acceleration The index 1 indicates the initial value to be chosen at the beginning of the winding process and the index 2 indicates the value at the moment when the load provided by the rider roll has reached its final value.

When the nip pressure of the rider roll has reached a chosen final value, the distance between the support rolls can be regulated at least substantially in accordance with the following expression:

$$b = 2(R + r)\sqrt{1 - \left(\frac{Q_2 + G_2}{C + Q_2}\right)^2} - r,$$

wherein

R = the outer radius of the web roll r = the radius of the support rolls $Q_2$ = a chosen final value of the nip pressure between the rider roll and the web roll G and C as stated above In the shown way the most advantageous regulation of the rider roll load is achieved. At the beginning, when it is needed, the load has its greatest value, and at the end there is no load at all, so that damages due to an uneven web profile, for example internal ruptures, do not occur.

The invention also relates to an arrangement for applying the method described above. The arrangement is characterized in that it is provided with a device for varying the distance between the support rolls during the winding process at least substantially symmetrically with respect to a vertical line through the center of the rider roll. It is also of advantage to provide the arrangement with means for removing failures of web rolls between the support rolls.

Figure 2:
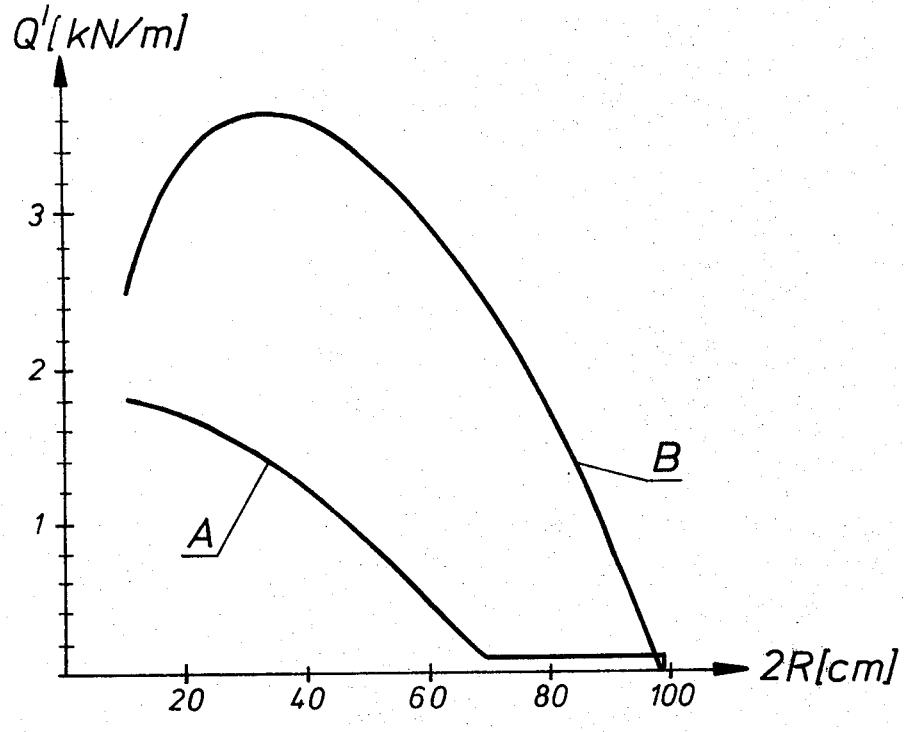
Figure 3:
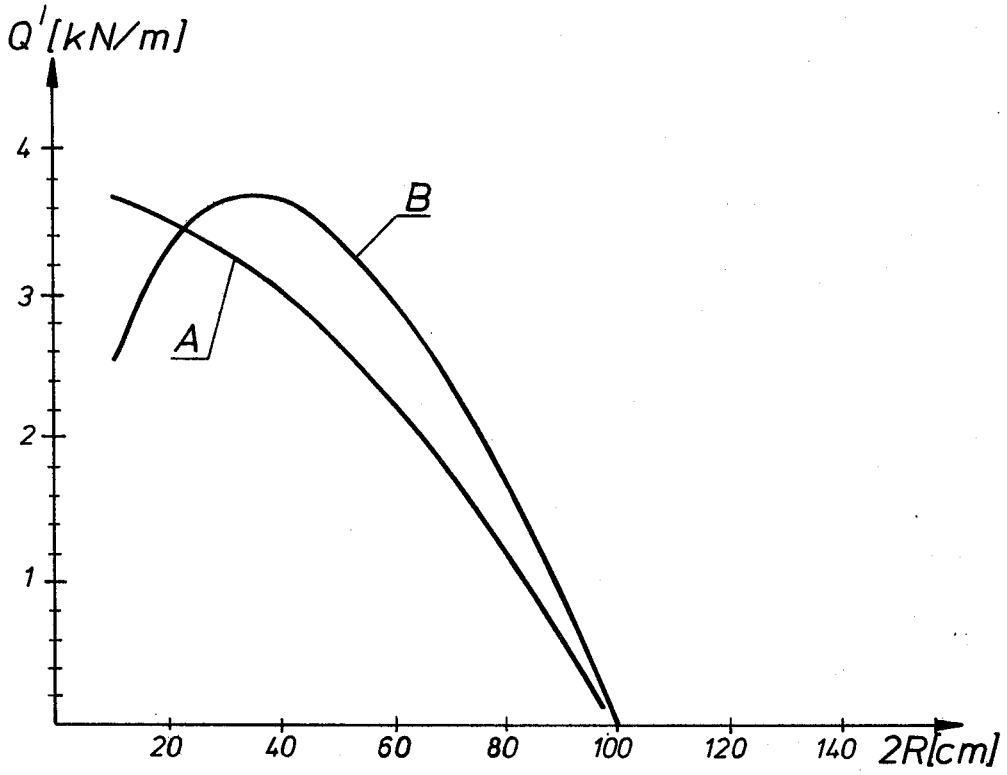
Figure 4:
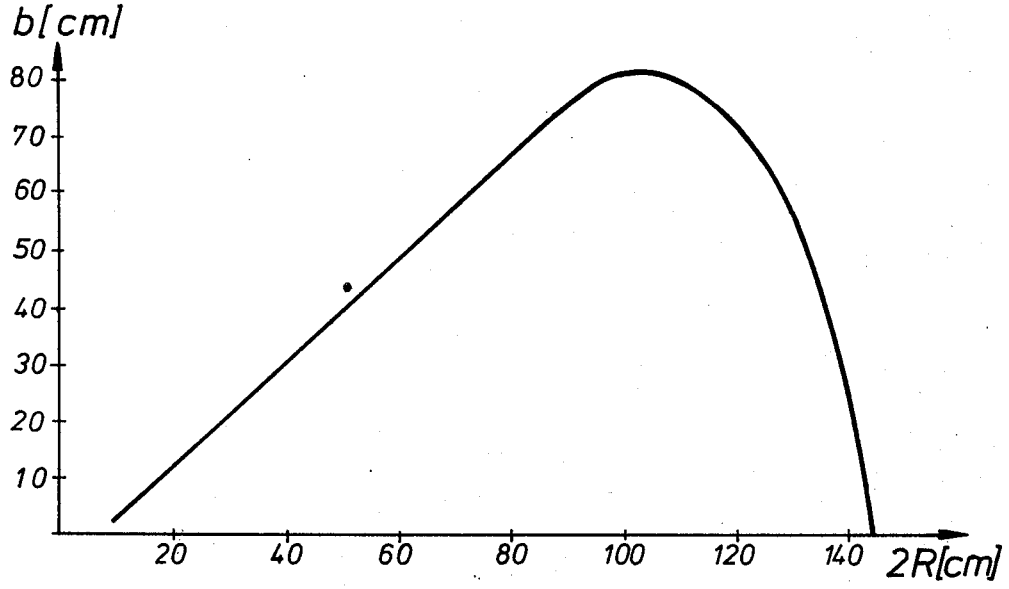
Figure 3:
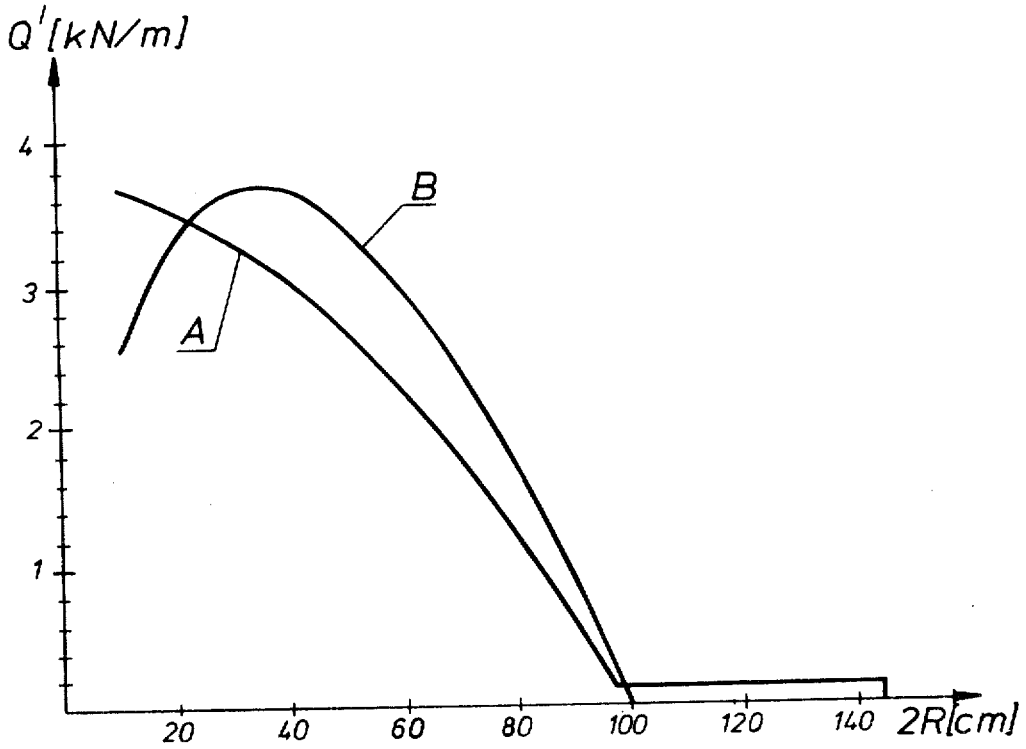
Figure 4:
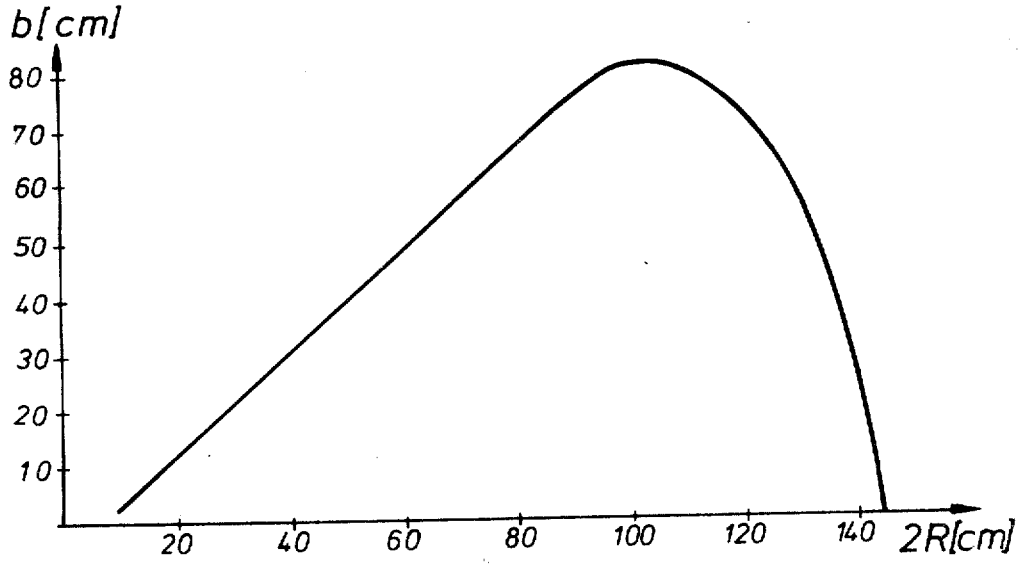

In the following, a regulation method according to the invention is illustrated i.a. by comparing it to a known regulation method by means of the attached drawing, where FIG. 1 shows the geometry of a two drum winder and the outer forces acting on the web roll in a static situation, FIG. 2 shows the regulation of the rider roll load as a function of the diameter of the web roll to be wound, according to the invention and in a conventional way, when in both cases the aim is to obtain the same web roll diameter, FIG. 3 shows a regulation comparison according to FIG. 2 when the same maximum rider roll load value is used in both cases, FIG. 4 shows a regulation according to the invention of the distance between the support rolls as a function of the diameter of the web roll to be wound.

In the drawing, the numeral 1 designates a rider roll and 2 support rolls between which a web 4 is wound around a core 3 to form a web roll 5. FIGS. 2, 3 and 4 are diagrams.

In FIGS. 2 and 3, A is a rider roll load curve according to the invention and B a rider roll load curve according to a known method. According to the known regulation method the rider roll load increases considerably at the beginning of the winding process when the aim is to keep the nip pressures between the support rolls and the web roll constant, which may easily cause damages in the web roll and an excessive increase of the tension in the web roll. In FIG. 2, the advantage obtained by a regulation according to the invention can be seen as a decrease in the nip pressure applied to the web roll by the rider roll and, which gives a better web roll quality.

In FIG. 3 it can be seen that when equal maximum rider roll load values are used when applying both regulation methods, and when the aim is to keep the quality of the web roll at the same level, a considerable growth in the diameter of the web roll can be achieved by means of the regulation method according to the invention as compared to a conventional regulation method.

FIG. 4 shows a program for varying the distance between the support rolls corresponding to the regulation of the rider roll load according to the invention and shown in FIG. 3.

The invention is not limited to the applications illustrated but several modifications thereof are feasible within the scope of the attached claims.

I claim:

1. A method for regulating the internal tension of a web roll being wound in a winder including two support rolls under said web roll and a rider roll above said web roll, the distance between the centers of said support rolls being kept, during the whole winding process, smaller than the sum of the distances from the center of said web roll to the centers of said support rolls, said method comprising the steps of increasing continuously the distance between said support rolls at the beginning of the winding process, and, at a later phase of the winding process, decreasing said distance.

2. A method as claimed in claim 1, including the step of keeping the angle between a line through the centers of said support rolls and a line through the center of one of said support rolls and of said web roll at least substantially constant during the phase of increasing the distance between said support rolls.

3. A method as claimed in claim 2, including the step of keeping, at the beginning of the winding process, the nip pressure of said rider roll close to a chosen initial value, and, thereafter, allowing said nip pressure to continuously decrease to its final value.

4. A method as claimed in claim 3, including the step of letting the nip pressure of said rider roll slightly decrease, during an initial phase of the winding process.

5. A method as claimed in claim 3, including the step of regulating the distance between said support rolls so that the sum of the nip pressures provided by said support rolls and said rider roll is at least substantially constant during the phase of decreasing the distance between said support rolls.

6. A method as claimed in claim 3, including the step of keeping the sum of the nip pressures provided by said support rolls and said rider roll at least substantially constant during the whole winding process.

7. A method as claimed in claim 6, including the step of regulating, at the beginning of the winding process, the nip pressure provided by said rider roll at least substantially in accordance with the following expression:

$$Q = \frac{C \sin(a) - G}{1 + \sin(a)},$$

wherein

Q = the nip pressure between said rider roll and said web roll

C = a constant a = the angle between a line through the centers of said support rolls and a line through the center of one of said support rolls and of said web roll G = the total weight of said web roll per axial length unit.

8. A method as claimed in claim 7, including the step of regulating the distance between said support rolls, when the nip pressure of said rider roll has reached a chosen final value, at least substantially in accordance with the following expression:

$$b = 2(R + r)\sqrt{1 - \left(\frac{Q_2 + G_2}{C + Q_2}\right)^2} - r,$$

wherein

R = the outer radius of said web roll r = the radius of said support rolls $Q_2$ = a chosen final value for the nip pressure between said rider roll and said web roll G and C as stated in claim 7.

9. A winding arrangement for applying the method claimed in claim 1, said arrangement including a device for varying the distance between said support rolls during a winding process at least substantially symmetrically with respect to a vertical line through the center of said rider roll.

* * * * *

UNITED STATES PATENT AND TRADEMARK OFFICE

CERTIFICATE OF CORRECTION

PATENT NO. 4,128,213

DATED : December 5, 1978

INVENTOR(S) : Pekka Komulainen, Kemi, Finland

It is certified that error appears in the above-identified patent and that said Letters Patent are hereby corrected as shown below:

In the Specification, Column 1, Line 13, change "drum" to --two-drum--

Column 1, Line 25, change "drum" to --two-drum--

Column 1, Line 33, change "drum" to --two-drum--

Column 1, Line 40, change "drum" to --two-drum--

Column 2, Line 8, change "drum" to --two-drum--

Column 3, Lines 1-5, in the equation, change "$\frac{Q_2+G_2}{C+Q_2}$" to --$\frac{Q_2+G}{C-Q_2}$--

Column 3, Line 32, of Fig. 1, delete "two-drum"

Column 5, Lines 1-5, in the equation, change "$\frac{Q_2+G_2}{C+Q_2}$" to --$\frac{Q_2+G}{C-Q_2}$--

Sheet 3 of the drawings should be deleted to appear as per attached sheet.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*